United States Patent [19]

Mitsuyoshi

[11] 4,238,119

[45] Dec. 9, 1980

[54] STEEL WIRE HEAT TREATMENT EQUIPMENT

[75] Inventor: Sinzi Mitsuyoshi, Amagasaki, Japan

[73] Assignee: Hiroyuki Kanai, Ashiya, Japan

[21] Appl. No.: 18,676

[22] Filed: Mar. 8, 1979

[51] Int. Cl.[3] ..... C21D 9/56

[52] U.S. Cl. ..... 266/100; 266/112

[58] Field of Search ..... 266/112, 100

[56] References Cited

U.S. PATENT DOCUMENTS 2,279,684 4/1942 Johnson ..... 266/112

*Primary Examiner*—R. Dean

*Attorney, Agent, or Firm*—Wenderoth, Lind & Ponack

[57] ABSTRACT

A steel wire heat treatment apparatus is entirely free from the disadvantage of oxidation of the steel wire during treatment. The apparatus includes a heating furnace with a plurality of heating pipes passing, and through which wire rods being heated are passed, and a tempering oil tank provided at a wire rod outlet side of the heating furnace. An end portion of the wire rod outlet side of each heating pipe communicates with the tempering oil tank. An oil-drain pipe is arranged below each heating pipe in such a fashion that one end thereof communicates with the heating pipe and the other end thereof is maintained immersed in oil within an oil-drain tank.

3 Claims, 4 Drawing Figures

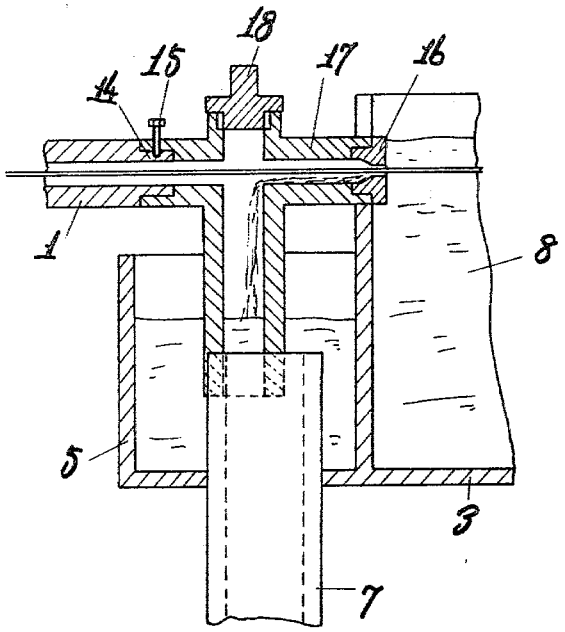
Fig. 2
Fig. 3
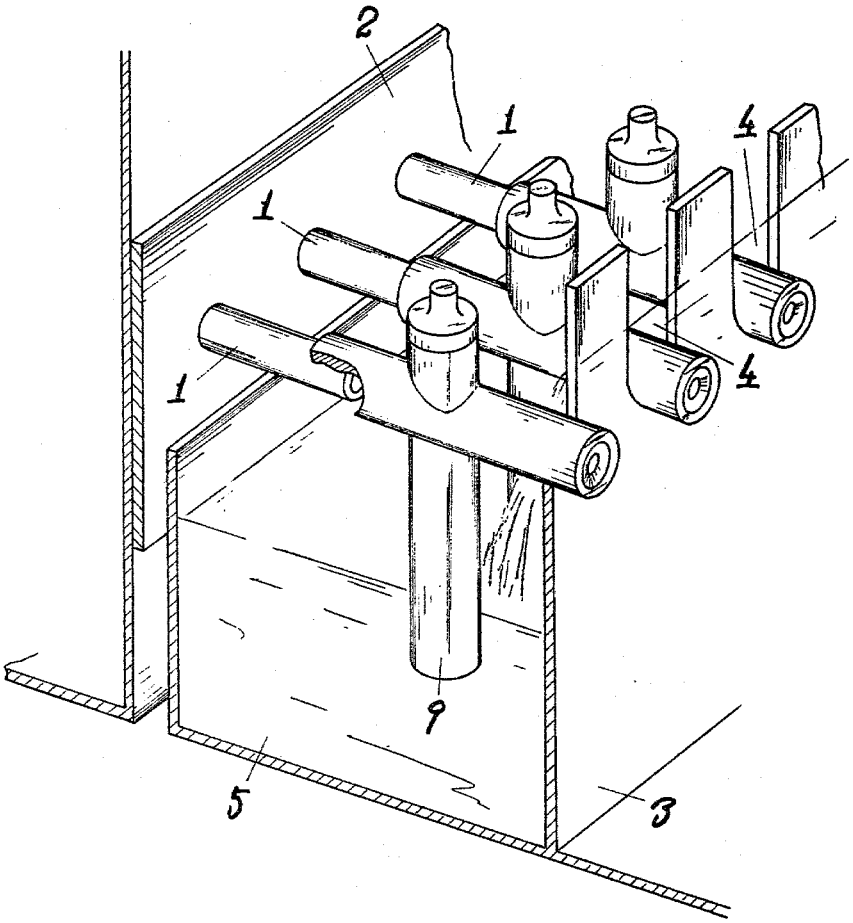

STEEL WIRE HEAT TREATMENT EQUIPMENT

BACKGROUND AND SUMMARY OF THE INVENTION

This invention relates to a steel wire heat treatment apparatus. More particularly, this invention relates to a device for heat treating steel wire without the disadvantage of oxidation of the surface of the wire.

In a conventional heat treatment apparatus for steel wire which uses an electric furnace including a direct firing system or an indirect heating system, since there exists a space between a wire rod outlet of the electric furnace and a tempering oil tank, a wire rod leaving the electric furnace in a red-hot condition has oxides form on its surface upon contact with air, with the result that a thick and strong oxidation film is produced at the surface of the wire rod. Accordingly, it is necessary to remove such film by pickling or by other means in a succeeding process. If a heated wire rod having an oxidation film on its surface is immersed in tempering oil, difficulties as irregularity of quenching and scratching of the wire rod surface by oxide stuck thereto at a process after quenching will take place, with resultant deterioration of the quality of a processed wire rod. In addition, oxide will come off and stain the treating equipment.

The present invention provides a system to eliminate the above-mentioned defects of the conventional heat treatment apparatus for steel wire, and the primary object of the present invention is to prevent oxidation of a steel wire during a heat treatment.

BRIEF DESCRIPTION OF THE DRAWINGS

The nature and advantages of the present invention will be understood more clearly from the following description made reference to the accompanying drawings, in which.

FIG. 2 is a cross-sectional, partly broken away, of another embodiment of a joint between a heating pipe and a tempering oil tank in the steel wire heat treatment apparatus of the present invention; and FIG. 3 is a perspective view of the main part of a steel wire heat treatment apparatus according to the present invention.

DETAILED DESCRIPTION OF THE INVENTION

Figure 1A:
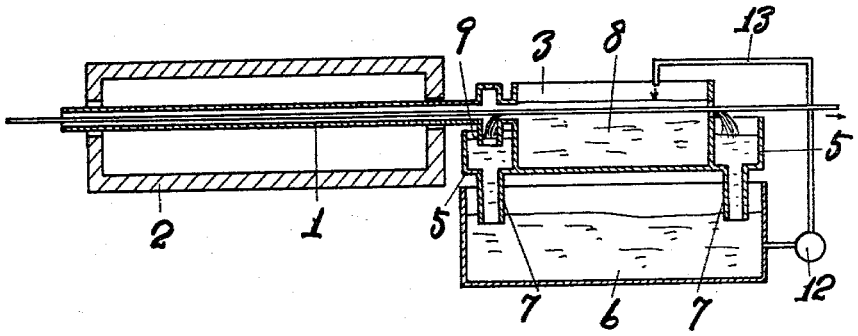
FIG. 1 (A) and FIG. 1 (B) are schematic cross-sectional views showing the construction of a steel wire heat treatment apparatus according to the present invention.

As shown in the drawings a heat treatment apparatus according to the present invention comprises mainly a heating furnace 2 with several heating pipes 1 arranged therethrough and a tempering oil tank 3 in alignment with the heating furnace 2. Tempering oil is filled into the tempering oil tank above the level of the openings of pipes into tank 3.

Figure 1B:
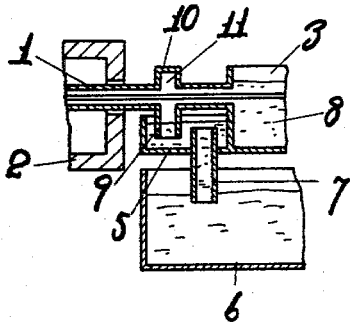

In the above-mentioned heat treatment apparatus, at least two oil-drain tanks 5 are provided at opposite ends of the tempering oil tank 3, as shown in FIG. 1 (A), and an oil storage tank 6 is provided below the oil-drain tanks 5. The oil-drain tanks 5 communicate with storage tank 6 by means of one or more oil feed pipes 7 which extend below the level of oil within storage tank 6.

Each heating pipe 1 has an integral oil-drain pipe 9, for draining tempering oil 8 which flows into the heating pipe 1. Each pipe 9 is above the oil-drain tank 5 at a location between the heating furnace 2 and the tempering oil tank 3. An outlet of the oil-drain pipe 9 is maintained immersed in oil of the oil-drain tank 5. In order to have the outlet of the oil-drain pipe 9 always immersed in oil, it is desirable to dispose an upper inlet of the oil feed pipe 7 above the level of the outlet of the oil-drain pipe 9, as shown in FIG. 1 (B). Also, it is possible to provide inspection window 11 by means of a transparent lid 10 made of synthetic resin or glass on each heating pipe 1 just above the respective oil-drain pipe 9. Such inspection window 11 can be made directly in heating pipe 1 or in a short pipe extending from the heating pipe 1.

The tempering oil tank 3 and the oil storage tank 6 are connected by a circulating pipe 13 via a pump 12. In order to maintain steel wire being treated below the level of oil in the tempering oil tank 3, tempering oil 8 stored in the oil storage tank 6 is fed gradually to the tempering oil tank 3 by means of the pump 12 as tempering oil in the tempering oil tank 3 flows out gradually through the outlet openings of pipes 1 and the oil-drain pipes 9. Thus, tempering oil is caused to circulate.

In a modification of the above construction, it is possible to provide joints between the heating pipes 1 and the tempering oil tank 3, as shown in FIGS. 2 and 3. Thus, each heating pipe 1 projecting horizontally from the heating furnace 2 and the tempering oil tank 3 are connected with each other by means of respective cross pipes 17 therebetween. Each cross pipe 17, has at one end thereof a locking member 15 adapted to be locked on reduced diameter portion 14 at the outlet end portion of the respective heating pipe 1. The other end of each cross pipe 17 may include an outlet 16 of nozzle shape through which a wire rod is passable. Each such other end of the cross pipes 17 is extended into a respective groove 4 formed in tank 3. An upward portion of each cross pipe 17 is formed into an inspecting window with a detachable lid 18. A downward portion of each cross pipe 17 is so designed that it is maintained immersed in oil in the oil-drain tank 5 and thus forms the oil-drain pipe 9. A lower end of the oil-drain pipe 9 of each cross pipe 17 is positioned lower than the upper end of the oil feed pipe 7 which extends from oil-drain tank 5 to the oil storage tank 6.

Since the heating apparatus according to the present invention is composed as mentioned above, it is suitable for oxidation-free quenching of various wire rods, such as oil tempered wire for machine springs, oil tempered wire of various modified cross sections, etc. According to the present invention, the use of protective gas is not required during quenching and therefore a device for generating protective gas is not necessary. Thus, heat treatment apparatus according to the present invention is simple in construction and inexpensive in cost.

Moreover, since an oil drain pipe is installed between a heating pipe and a tempering oil tank which are connected to each other, backward flow of tempering oil into the heating pipe and also combustion of the tempering oil is prevented. Furthermore, as the outlet of the heating pipe is perfectly screened from the air, the temperature of the entire length of the heating pipe rises at the start of operation of the apparatus, with the result that the air in the heating pipe expands and becomes thin. Therefore, any residual quantity of oxygen becomes small and the air combines immediately with oil on the surface of wire rod and changes into $CO_2$ and CO, in other words, changes into non-oxidizing gas which fills the heating pipe as protective gas of good quality. This protective gas remains in the heating pipe during operation. Thus, oxidation of the surface of the wire rod is perfectly prevented, and a wire rod with a clean surface and free from oxidation scale can be obtained. Moreover, as the wire rod passes through from the inlet of the heating pipe to the outlet of the tempering oil tank without the slightest contact with air, no lowering of temperature is involved during operation and therefore a wire rod of high quality, with excellent straightness and free from irregular quenching can be produced.

What is claimed is:

1. A steel wire heat treatment apparatus comprising:

a heating furnace;

a plurality of heating pipes extending through said heating furnace, whereby wire rods passed through said heating pipes are heated by heat from said furnace;

a tempering oil tank positioned at a wire rod outlet end of said furnace, said tempering oil tank having therein tempering oil within which said wire rods are immersed and thereby tempered;

a plurality of cross-shaped pipes, each said cross-shaped pipe having a wire inlet branch pipe portion detachably connected to a wire rod outlet end of a respective said heating pipe, and a wire outlet branch pipe portion extending into said tempering oil tank at a position below the surface of said tempering oil therein, such that said tempering oil flows from said tempering oil tank through said wire outlet branch pipe portion into said cross-shaped pipe, and whereby each said wire rod being treated passes through a respective said heating pipe, directly through a respective said cross-shaped pipe, and directly into said tempering oil within said tempering oil tank;

each said cross-shaped pipe including an upper branch pipe portion having therein a detachable lid and an inspection window, whereby the condition and quality of said wire rod passing through said cross-shaped pipe can be inspected;

an oil drain tank positioned below all of said cross-shaped pipes;

an oil storage tank positioned below said oil drain tank;

at least one oil feed pipe extending from said oil drain tank to said oil storage tank, said oil feed pipe having an upper end extending into said oil drain tank and a lower end extending into said oil storage tank;

each said cross-shaped pipe including a lower branch pipe portion which forms an oil drain pipe which extends downwardly into said oil drain tank and which has a lower end positioned at a level below said upper end of said oil feed pipe;

whereby said tempering oil which flows into said cross-shaped pipes from said tempering oil tank then flows downwardly through said oil drain pipes into said oil drain tank and maintains therein an oil level above said lower ends of said drain pipes, and then flows downwardly through said oil feed pipe into said oil storage tank; and means for recirculating said tempering oil from said oil storage tank back to said tempering oil tank.

2. An apparatus as claimed in claim 1, wherein said tempering oil tank has therein grooves into which extend said wire outlet branch pipe portions of said cross-shaped pipes.

3. An apparatus as claimed in claim 1, wherein each said wire outlet branch pipe portion includes an outlet opening of reduced diameter in the form of a nozzle opening.

* * * * *